US006053576A

United States Patent [19]

Jessee

[11] Patent Number: 6,053,576

[45] Date of Patent: Apr. 25, 2000

[54] BANK OF SEATS FOR AMUSEMENT RIDE

[76] Inventor: Michael J Jessee, 3350 SW. Temple, Salt Lake City, Utah 84115

[21] Appl. No.: 09/183,625

[22] Filed: Oct. 30, 1998

[51] Int. Cl.[7] ..... A47C 1/02

[52] U.S. Cl. ..... 297/344.19; 472/58; 472/59; 472/60; 297/232; 297/344.16

[58] Field of Search ..... 297/344.19, 344.11, 297/344.12, 344.13, 344.14, 344.17, 344.16, 344.2, 232, 248, 249, 257, 258.1, 259.1, 260.2; 52/9, 10; 472/58, 59, 60; 434/55

[56] References Cited

U.S. PATENT DOCUMENTS

| | | | |
|---|---|---|---|
| 4,874,162 | 10/1989 | Trumbull et al. | 272/18 |
| 4,879,849 | 11/1989 | Hollingsworth, III et al. | 52/10 |
| 5,199,875 | 4/1993 | Trumbull | 434/58 X |
| 5,433,670 | 7/1995 | Trumbull | 472/60 |
| 5,597,359 | 1/1997 | Byerly | 472/60 |
| 5,669,773 | 9/1997 | Gluck | 434/55 X |
| 5,678,889 | 10/1997 | Purcell, Jr. | 297/344.16 X |
| 5,931,739 | 8/1999 | Layer et al. | 472/60 |

*Primary Examiner*—Laurie K. Cranmer

*Attorney, Agent, or Firm*—Terry M. Crellin

[57] ABSTRACT

A bank of seats for use in an amusement type environment has at least two seats arranged in side-by-side orientation with all seats facing in the same direction. The bank of seats has a substantially planar platform and upstanding, forward support arms attached to the platform in spaced apart positions adjacent at the front edge of the platform. In addition, upstanding, rearward support arms are attached to the platform at spaced apart positions adjacent to the back edge of the platform to form respective pairs of forward and rearward support arms. Each of the seats is mounted for pivotal movement about a pivot axis that is adjacent to the distal ends of a respective pair of forward and rearward support arms. All of the seats are pivoted in unison about their respective pivot axes so that each seat sways from side to side in substantially the same pivotal movement as all other of the seats. Independent mechanisms raise and lower the front and back edges of the planar platform. The mechanisms for raising and lowering the front and back edges of the planar platform are operated independently of each other so that the movement of the front edge of the planar platform can be controlled independent of the movement of the back edge of the planar platform.

10 Claims, 2 Drawing Sheets

BANK OF SEATS FOR AMUSEMENT RIDE

BACKGROUND OF THE INVENTION

1. Field of the Invention

The present invention relates to seats used in amusement rides and especially banks of seats used in rides in which the seats are incorporated with a theater and are operated in conjunction with a motion picture that established the environment for the seats and the action of the seats.

2. State of the Art

Providing a motion simulation environment to produce physical motion to passengers in a seat has been used in theater type rides, wherein motion is imparted to the seats of the passengers to simulate the environment of the motion being depicted on the theater screen. This motion adds to the realism of the theater presentation. A variety of motion devices have been developed to meet this need. Motion simulators have traditionally been provided with three degrees of movement so as to provide heave (up and down), roll (tipping down on either side) and pitch (tipping up or down in the front or the back).

Many of the devices of the prior art are designed to operate a single chair or seat. The undesirable aspect of such systems becomes quite evident. Each seat in the theater requires its own actuation mechanism. The great number of actuators requires a large investment in physical components that are repeated for each seat in the theater. In addition, the means for driving each of the actuation mechanisms must be repeated for each seat.

Bench type simulators have been suggested in a variety of forms, with the most common being a row of seats which can move up and down, tilt from side to side, and tip toward the front or the back. Complicated platform mechanisms are required which again make the seating arrangement in a theater very expensive. In addition, there is generally no means been suggested for individual rotation of a seat in the bank of seats as opposed to simple tilting of the platform from side to side. Various examples of platform systems are shown in U.S. Pat. No. 5,509,631 and the numerous U.S. Patents referenced in U.S. Pat. No. 5,509,631.

OBJECTIVES AND BRIEF DESCRIPTION OF THE INVENTION

A principal objective of the invention is to provide a novel bank of seats in which all the seats in the bank are actuated by three actuators to provide three degrees of motion for each of the seats in the bank.

A further objective of the present invention is to provide such a bank of seats wherein each seat is adapted to rotate about its own pivot axis beneath the seat to provide side to side motion for each seat rather than rely on motion of the platform upon which the seats are supported for such side to side motion.

A still further objective of the present invention is to provide a bank of seats that is simple in construction and thereby relatively inexpensive as compared to prior art motion imparting seats.

The above objectives are achieved in accordance with the present invention by providing a novel bank of seats having at least two seats arranged in side-by-side orientation, with all seats facing in the same direction. The bank of seats comprises a substantially planar platform having a front edge and a back edge that are substantially parallel with each other. At least two upstanding, forward support arms are attached to the platform in spaced apart positions adjacent to the front edge of the platform. At least two upstanding, rearward support arms are attached to the platform at spaced apart positions adjacent to the back edge of the platform to form respective pairs of forward and rearward support arms. The distal ends of each of the respective pairs of forward and rearward support arms extend upwardly substantially the same distance above the planar platform so that straight lines through the distal ends of the respective pairs of forward and rearward support arms are substantially parallel with the planar platform.

Each seat is pivotally mounted each of the seats about a pivot axis that is adjacent to the distal ends of a respective pair of forward and rearward support arms, with the front of each seat positioned near a forward support arm and the back of each seat is positioned near a rearward support arm. Means are provided for pivoting all of the seats in unison about their respective pivot axes so that each seat sways about its own pivot axis in a side to side movement that is substantially the same as all other of the seats.

A first mechanism raises and lowers the front edge of the planar platform so the fronts of each of the seats can be raised and lowered in unison, and a second mechanism raises and lowers the back edge of the planar platform so that the backs of each of the seats can be raised and lowered in unison. The mechanisms for raising and lowering the front and back edges of the planar platform are operated independently of each other so that the movement of the front edge of the planar platform can be controlled independent of the movement of the back edge of the planar platform.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1 is a pictorial representation of a bank of seats in accordance with the present invention; and FIG. 2 is a front elevation of the bank of seats of FIG. 1.

DETAILED DESCRIPTION OF THE ILLUSTRATED EMBODIMENT

Figure 1:
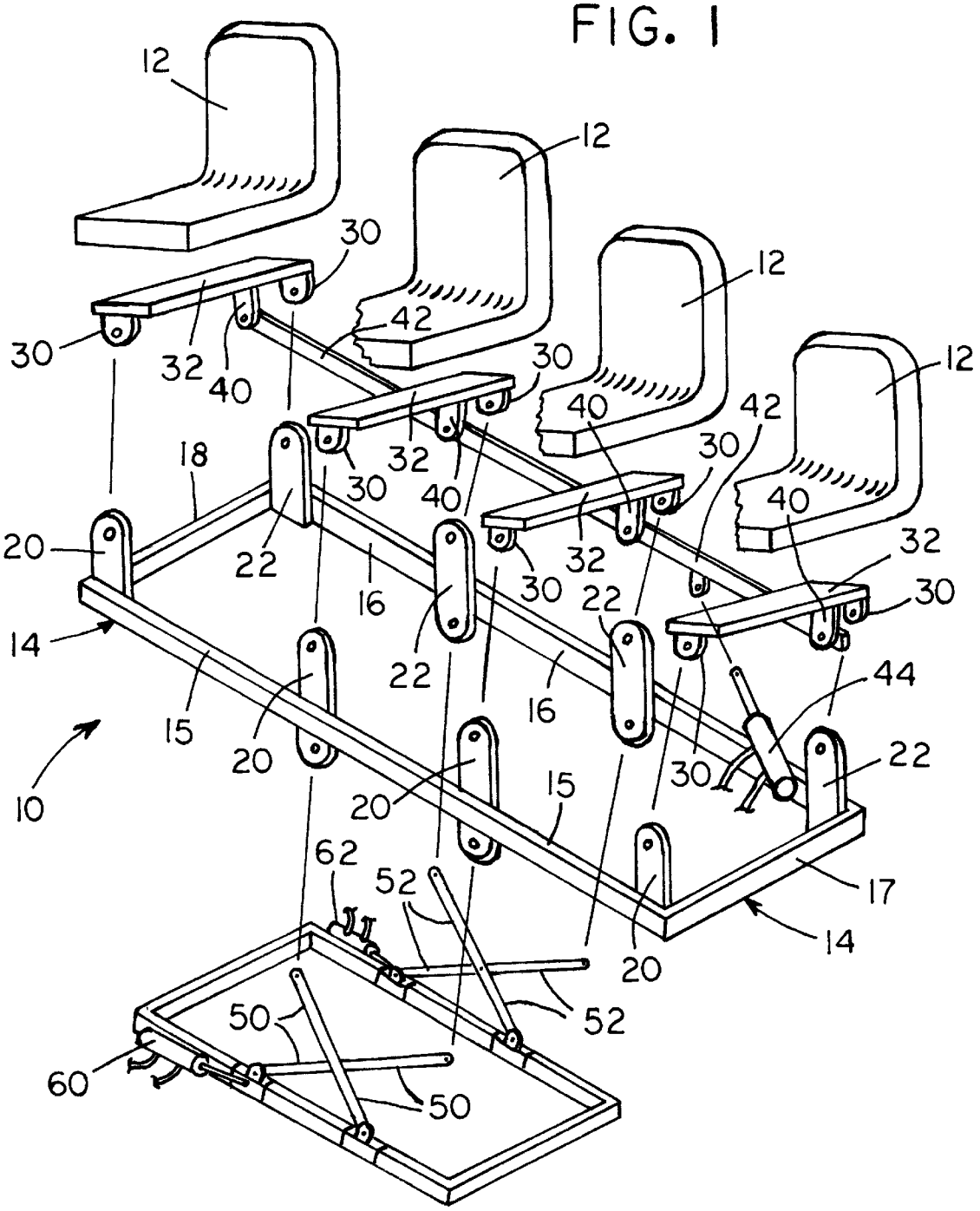
Figure 2:
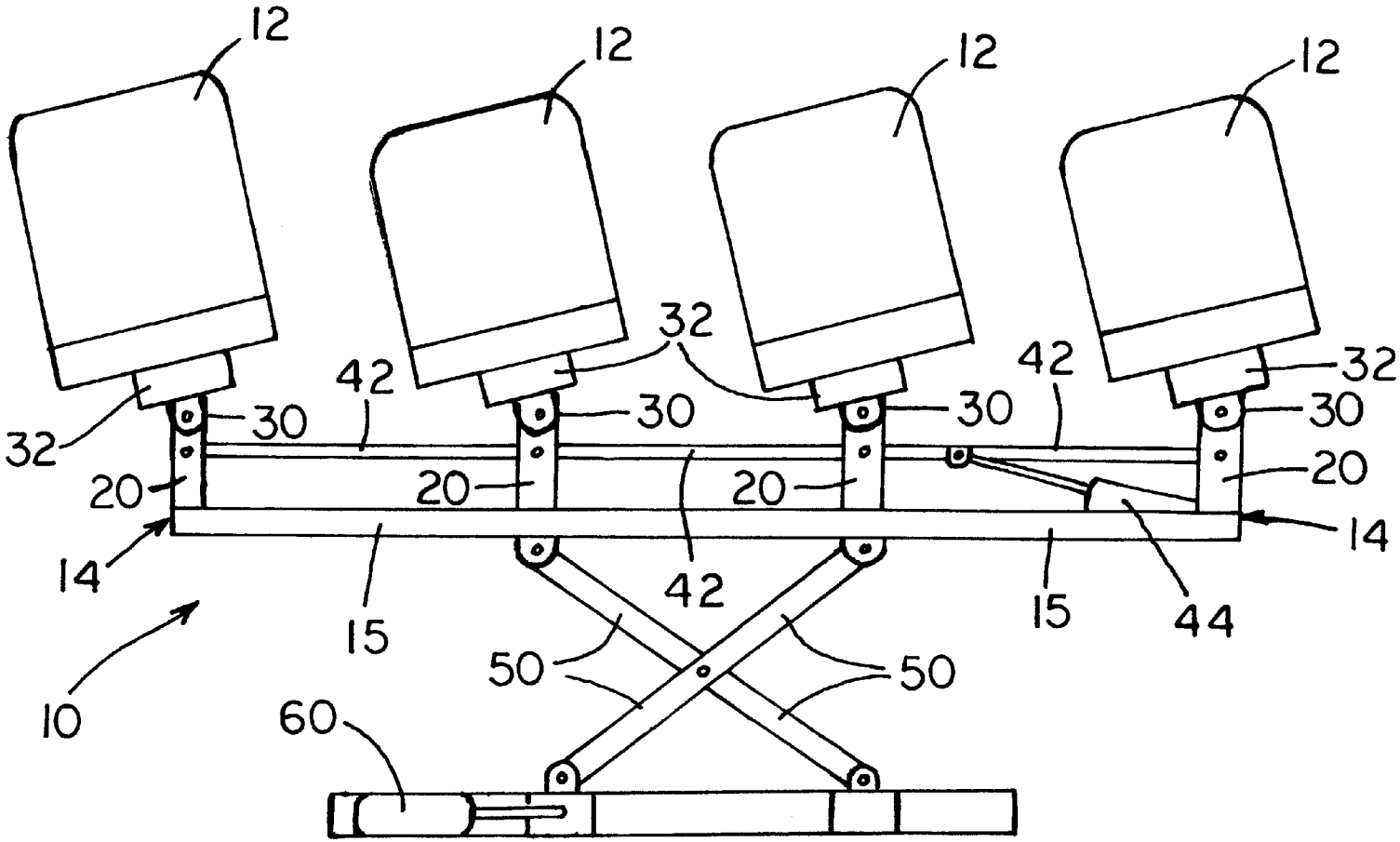

Referring now to the drawings, a preferred embodiment of the invention is shown comprising a bank 10 of seats 12. As illustrated the bank 10 has four seats 12 that are arranged in side-by-side orientation, with all seats 12 facing in the same direction. The bank 10 of seats 12 could have as few as two seats and as many as is practical under the circumstances. FIG. 1 shows the components of the bank of seats 12 in exploded fashion, while FIG. 2 shows a front view of the bank 10 of seats 12, with the components of the bank 10 of seats 12 being shown in their normal, interconnected condition.

The bank 10 of seats 12 comprises a substantially planar platform 14 having a front edge and a back edge that are substantially parallel with each other. As illustrated, the platform 14 also has two side edges that are substantially perpendicular to the front and back edge and parallel with each other so that the platform 14 is substantially rectangular in shape. Advantageously, the platform 14 comprises an elongate front member 15 whose forward side edge forms the front edge of the platform 14 and an elongate back member 16 whose rearward side edge forms the back edge of the platform 1.

An elongate first side member 17 has (1) its one end firmly attached to a first end of the elongate front member 15 and (2) its other end firmly attached to a first end of the elongate back member 16. The first side member 17 is substantially perpendicular to both the elongate front member 15 and the elongate back member 16. An elongate second side member 18 has (1) its one end firmly attached to a second end of the elongate front member 15 and (2) its other end firmly attached to a second end of the elongate back member 16. The second side member 18 is substantially perpendicular to both the elongate front member 15 and the elongate back member 16, such that the platform 14 is substantially rectangular.

In the illustrated embodiment, four upstanding, forward support arms 20 are attached to the platform 14 in spaced apart positions adjacent to the front edge of the platform 14. In addition, four upstanding, rearward support arms 22 are attached to the platform 14 at spaced apart positions adjacent to the back edge of the platform 14 to form respective pairs of forward and rearward support arms 20 and 22. Distal ends of each of the respective pairs of forward and rearward support arms 20 and 22 extend upwardly substantially the same distance above the planar platform 14 so that straight lines through the distal ends of the respective pairs of forward and rearward support arms 20 and 22 are substantially parallel with the planar platform 14.

In the illustrated embodiment of the bank 10 of seats 12 of the present invention, the upstanding, forward support arms 20 are attached to the elongate front member 15, and the upstanding, rearward support arms 22 are attached to the elongate back member 16. Means are provided for pivotally mounting each of the seats 12 about a pivot axis that is adjacent to the distal ends of a respective pair of forward and rearward support arms 20 and 22 so that the front of each seat 12 is near a forward support arm 20 and the back of each seat is near a rearward support arm 22.

As illustrated in the drawings, a pair of lugs 30 extend downwardly from an underneath side of each seat 12. As shown, each seat 12 has a support base 32 that forms the underneath side of the seat 12. One lug 30 of each pair is located near a forward side of the seat 12, and the other lug 30 of each pair is located near a rearward side of the respective seat 12. Both lugs 30 in each pair are positioned substantially equal distances from opposite lateral sides of the seat 12 so that an imaginary line extending through each pair of lugs 30 lies in a plane that bisects the respective seat 12. Pivot pins extend through aligned openings in (1) the distal end of a forward support arm 20 and a corresponding opening in one of the lugs 30, and (2) the distal end of a rearward support arm 22 and a corresponding opening in the other of the lugs 30 of the respective pair of lugs.

The bank 10 of seats 12 of the present invention is provided with means for pivoting all of the seats 12 in unison about the respective pivot axes of the seats 12, so that each seat 12 sways from side to side in substantially the same pivotal movement as all other of the seats 12. As shown in the drawings, extension arms 40 extend downwardly from an underneath side of each of the bases 32 of the seats 12.

An elongate actuator member 42 extends adjacent to lower ends of the extension arms 40, with the lower ends of each of the extension arms 40 being pivotally connected to the actuator member 42. A hydraulic cylinder 44 or other equivalent mechanism is provided for moving the actuator member 42 back and forth in a direction along a longitudinal axis of the actuator member 42. As the actuator member 42 moves back and forth, the seats 12 in the bank 10 sway from side to side in unison with each other.

Independent mechanisms are provided for raising and lowering the front edge and the rear edge of the planar platform 14 that allows the fronts and backs of the seats 12 to be raised and lowered. The fronts of the seats 12 are raised and lowered in unison, and the backs of the seats 12 are raised and lowered in unison. But, the motion of the fronts of the seats and the back of the seats is independent, i.e., the fronts of the seats can be raised while the backs are being lowered or vice-versa, and the fronts can be raised or lowered along with the backs at different rates or the same rate as the backs. The mechanism for raising and lowering the front edge of the planar platform 14 and the mechanism for raising and lowering the back edge of the planar platform 14 are operated independently of each other so that the movement of the front edge of the planar platform 14 can be controlled independent of the movement of the back edge of the planar platform 14.

The mechanisms for raising and lowering the front edge and the back edge of the planar platform 14 advantageously comprises first and second scissors jacks 50 and 52. The first scissors jack mechanism 50 is attached to the elongate front member 15 of the planar platform 14 so that the first scissors jack mechanism 50 supports the elongate front member 15. The second scissors jack mechanism 52 is attached to the elongate back member 16 of the planar platform 14 so that the second scissors jack mechanism 52 supports the elongate back member 16.

Means are provided for independently actuating the first and second scissors jack mechanism 50 to independently raise and lower the elongate front and back members 15 and 16. In the embodiment illustrated in the drawings, the means for actuating the first scissors jack mechanism 50 is a hydraulic cylinder 60 that is operably connected to the lower ends of the first scissors jack mechanism 50. The means for actuating the second scissors jack mechanism 52 is another hydraulic cylinder 62 that is operably connected to the lower ends of the second scissors jack mechanism 52.

Although a preferred embodiment of a bank of seats in accordance with the present invention has been illustrated and described, it is to be understood that the present disclosure is made by way of example and that various other embodiments are possible without departing from the subject matter coming within the scope of the following claims, which subject matter is regarded as the invention.

I claim:

1. A bank of seats having at least two seats arranged in side-by-side orientation with all seats facing in the same direction, said bank of seats comprising a substantially planar platform having a front edge and a back edge that are substantially parallel with each other;

at least two upstanding, forward support arms attached to said platform in spaced apart positions adjacent to the front edge of said platform;

at least two upstanding, rearward support arms, each rearward support arm being attached to said platform at spaced apart positions adjacent to the back edge of said platform to form respective pairs of forward and rearward support arms, with distal ends of each of the respective pairs of forward and rearward support arms extending upwardly substantially the same distance above said planar platform so that straight lines through the distal ends of said respective pairs of forward and rearward support arms are substantially parallel with said planar platform;

means for pivotally mounting each of said seats about a pivot axis that is adjacent to the distal ends of a respective pair of forward and rearward support arms so that the front of each seat is near a forward support arm and the back of each seat is near a rearward support arm;

means for pivoting all of said seats in unison about their respective pivot axes so that each seat sways from side to side in substantially the same pivotal movement as all other of the seats;

means for raising and lowering said front edge of said planar platform so the fronts of each of the seats can be raised and lowered in unison;

means for raising and lowering said back edge of said planar platform so that the backs of each of the seats can be raised and lowered in unison; and said means for raising and lowering said front edge of said planar platform and said means for raising and lowering said back edge of said planar platform being operated independently of each other so that the movement of the front edge of said planar platform can be controlled independent of the movement of the back edge of said planar platform.

2. The bank of seats in accordance with claim 1 in which the bank of seats has four seats.

3. The bank of seats in accordance with claim 1 in which the platform has two side edges that are substantially parallel with each other so that said platform is substantially rectangular.

4. The bank of seats in accordance with claim 1 in which the platform comprises an elongate front member whose forward side edge forms the front edge of said platform;

an elongate back member whose rearward side edge forms the back edge of said platform;

an elongate first side member having (1) its one end firmly attached to a first end of said elongate front member and (2) its other end firmly attached to a first end of said elongate back member, with said first side member being substantially perpendicular to both said elongate front member and said elongate back member; and an elongate second side member having (1) its one end firmly attached to a second end of said elongate front member and (2) its other end firmly attached to a second end of said elongate back member, with said second side member being substantially perpendicular to both said elongate front member and said elongate back member, whereby said platform is substantially rectangular.

5. The bank of seats in accordance with claim 4 wherein said upstanding, forward support arms are attached to said elongate front member and said upstanding, rearward support arms are attached to said elongate back member.

6. The bank of seats in accordance with claim 5 wherein said means for pivotally mounting each of said seats about a pivot axis that is adjacent to the distal ends of a respective pair of forward and rearward support arms comprises a pair of lugs that extend downwardly from an underneath side of each seat, with one lug being located near a forward side of said seat and the other lug being located near a rearward side of said seat, wherein both lugs are positioned substantially equal distances from opposite lateral sides of said seat; and pivot pins that extend through aligned openings in (1) the distal end of a forward support arm and a corresponding opening in said one of said lugs, and (2) the distal end of a rearward support arm and a corresponding opening in said other of said lugs.

7. The bank of seats in accordance with claim 6 wherein said means for pivoting all seats in unison comprises extension arms that extend downwardly from an underneath side of each of said seats;

an elongate actuator member that extends adjacent to lower ends of said extension arms, with the lower ends of each of said extension arms being pivotally connected to said actuator member; and means for moving said actuator member back and forth in a direction along a longitudinal axis of said actuator member.

8. The bank of seats in accordance with claim 7 wherein said means for moving said actuator member back and forth is a hydraulic cylinder.

9. The bank of seats in accordance with claim 5 wherein said means for raising and lowering said front edge of said planar platform and said means for raising and lowering said back edge of said planar platform comprises a first scissors jack mechanism attached to said elongate front member of said planar platform so that said first scissors jack mechanism supports said elongate front member;

means for actuating said first scissors jack mechanism to raise and lower said elongate front member;

a second scissors jack mechanism attached to said elongate back member of said planar platform so that said second scissors jack mechanism supports said elongate back member; and means for actuating said second scissors jack mechanism to raise and lower said elongate back member.

10. The bank of seats in accordance with claim 9 wherein said means for actuating said first scissors jack mechanism is a hydraulic cylinder, and said means for actuating said second scissors jack mechanism is another hydraulic cylinder.

* * * * *